US005424182A

United States Patent [19]

Marginean, Sr. et al.

[11] Patent Number: 5,424,182

[45] Date of Patent: Jun. 13, 1995

[54] AQUEOUS COATING COMPOSITION FOR THERMAL IMAGING FILM

[75] Inventors: Barry L. Marginean, Sr., Scottsville; Simon R. Cuch, Canandaigua; Clinton A. Whittaker, Manchester; Mayur C. Patel, Fairport, all of N.Y.

[73] Assignee: Labelon Corporation, Canandaigua, N.Y.

[21] Appl. No.: 119,721

[22] Filed: Sep. 10, 1993

Related U.S. Application Data

[63] Continuation-in-part of Ser. No. 46,670, Apr. 13, 1993, abandoned, which is a continuation-in-part of Ser. No. 5,003, Jan. 15, 1993, abandoned.

[51] Int. Cl.[6] ..... G03C 1/498; G03C 1/38

[52] U.S. Cl. ..... 430/617; 430/338; 430/341; 430/523; 430/631; 430/961; 430/965

[58] Field of Search ..... 430/617, 618, 338, 341, 430/631, 965, 523, 961

[56] References Cited

U.S. PATENT DOCUMENTS

| | | | |
|---|---|---|---|
| 3,031,329 | 4/1962 | Wingert . | |
| 3,080,254 | 3/1963 | Grant, Jr. . | |
| 3,446,648 | 5/1969 | Workman . | |
| 4,082,901 | 4/1978 | Laridon et al. . | |
| 4,116,786 | 9/1978 | Hodakowski . | |
| 4,181,771 | 1/1980 | Hanson et al. . | |
| 4,289,535 | 9/1981 | Marginean et al. . | |
| 4,353,980 | 10/1982 | Helling et al. | 430/532 |
| 4,395,484 | 7/1983 | McCarney . | |
| 4,460,727 | 7/1984 | Shoji | 524/215 |
| 4,587,206 | 5/1986 | Sakaguchi et al. | 430/617 |
| 4,588,674 | 5/1986 | Stewart et al. . | |
| 4,619,888 | 10/1986 | Kawata et al. . | |
| 4,636,819 | 1/1987 | Nagamoto et al. . | |
| 4,675,705 | 6/1987 | Marginean et al. . | |
| 4,886,739 | 12/1989 | Przezdziecki . | |
| 4,942,115 | 7/1990 | Przezdziecki . | |
| 4,952,486 | 8/1990 | Sack et al. . | |
| 4,983,505 | 1/1991 | Higuchi et al. . | |
| 5,026,606 | 6/1991 | Isbrandt et al. . | |
| 5,057,570 | 10/1991 | Miller et al. | 524/503 |
| 5,260,180 | 11/1993 | Sahyun et al. . | |

OTHER PUBLICATIONS

Data Sheet of BYK-Chemie U.S.A. "Additive to Increase Mar Resistance, Add Slip as well as Surface Flow" (Believed to be dated prior to Jan. 15, 1993).

Manufacturing Chemical Aerosol News, Feb. 1980, p. 19.

Witco, Organics Division Product Guide entitled "Metallic Stearates and Metal Organics," pp. 1, 5, front and back covers (1991).

Manf. Chem. Aerosol News, Feb. 1980, p. 19.

Research Disclosure, Dec. 1989, pp. 993–1015.

*Primary Examiner*—Thorl Chea

*Attorney, Agent, or Firm*—Nixon, Hargrave, Devans & Doyle

[57] ABSTRACT

A heat-sensitive coating composition, and heat-sensitive material for thermal imaging containing the heat sensitive composition. The composition comprises a color-forming amount of a finely divided, solid, colorless noble metal salt of an organic acid; a color-developing amount of an organic reducing agent which at thermal copy and printing temperatures is capable of a color-forming reaction with the noble metal salt; an image toning agent; and a carrier composition in which the noble metal salt, organic reducing agent, and toning agent are distributed. The carrier composition requires no organic solvents and comprises one or more substantially water-soluble polymeric carrier materials and a solubility-enhancing amount of a dispersing agent. A protective, clarifying, radiation-cured overcoat is provided. Methods of forming the heat-sensitive composition and the overcoat are also disclosed.

30 Claims, 1 Drawing Sheet

AQUEOUS COATING COMPOSITION FOR THERMAL IMAGING FILM

CROSS-REFERENCE TO RELATED APPLICATIONS

This application is a continuation-in-part of U.S. application Ser. No. 08/046,670, filed Apr. 13, 1993, now abandoned which is a continuation-in-part of U.S. application Ser. No. 08/005,003, filed Jan. 15, 1993, now abandoned.

FIELD OF THE INVENTION

The present invention is directed to an improved heat-sensitive coating composition and to heat-sensitive film or paper-based materials containing the composition. The materials are particularly well suited for use in infrared copy and direct thermal printing devices.

BACKGROUND OF THE INVENTION

In the past several years, direct thermal imaging by thermal imaging printers has become a popular method for recording documents and data due to the low cost and reliability of equipment. Infrared imaging is also a convenient and inexpensive way to produce monochrome thermal transparencies for overhead projector presentations. Technology commonly used for direct thermal printing devices is well known and described in U.S. Pat. Nos. 4,289,535 and No. 4,675,705 where colorless or pale colored chromogenic dyestuffs are combined with a color-developing agent such as benzyl-p-hydroxy benzoate or 4,4'-isopropylidenediphenol. This technology, however, is not well suited for the manufacture of single sheet, transparent films for overhead projection presentations. The technology commonly used to produce single sheet, transparent black image films is also well known and is described in several United States patents including U.S. Pat. Nos. 3,080,254, 3,031,329, 3,446,648 and 5,026,606, in which a noble metal salt of an organic acid, preferably silver behenate or silver stearate, is reduced by an incorporated cyclic organic reducing agent such as the methyl ester of gallic acid in the presence of a toning agent to produce a dense black image. The color-forming layer is clarified by the application of polymeric overcoats such as cellulose acetate.

This art also teaches that resin binders suitable for the carrier system of the inventions are only those which are soluble in organic solvents such as methyl ethyl ketone, acetone, and heptane. The use and disposal of organic solvents, however, raises environmental and worker safety concerns. These solvents are inherently flammable or explosive and their use requires specially-adapted and expensive manufacturing equipment. In addition, they are effluent of the manufacturing process and must be recovered or burned, thus adding to the cost of manufacture.

Furthermore, the single sheet transparency compositions commercially available for use in direct thermal printing applications have been found to cause sticking of the imaging material to the print head, and have had insufficient sensitivity or thermal response characteristics to produce an adequately dense black output. In addition, commercially available compositions exhibit low maximum density (D-max), high minimum density (D-min), and high light scatter or haze.

Thus, there exists a continuing need for thermal imaging materials which can be manufactured safely and with no adverse environmental impact; which will produce images of great clarity with little haze, very high maximum density, and low minimum density; and which will not stick to the print head :nor cause melted material to accumulate on the print head.

SUMMARY OF THE INVENTION

The invention provides an improved heat-sensitive coating composition and heat-sensitive film or paper which overcomes the prior art problems described above.

An aqueous, heat-sensitive composition has now been discovered which exhibits improved imaging characteristics when used in infrared copying machines, such as a 3M Model 45 infrared copier, as well as in commercially available direct thermal printing devices such as wide format direct thermal plotters sold by CalComp under the trademark DrawingMaster Plus. The composition of the present invention is typically used in a composite multilayer film configuration wherein the color forming layer comprises a color-forming amount of a finely divided, solid colorless noble metal salt of an organic acid; a color-developing amount of a cyclic organic reducing agent, which at thermal copy and printing temperatures is capable of a color-forming reaction with said noble metal salt; an image toning agent; and a carrier composition in which said noble metal salt, organic reducing agent, and image toning agent are distributed, comprising one or more substantially water-soluble polymeric carrier materials and a solubility-enhancing amount of a dispersing agent.

The composite film preferably further includes a protective overcoat layer which comprises a radiation-curable composition comprising a blend of one or more reactive monomers that when sufficiently cured will melt, soften, or decompose only at temperatures greater than those attained by commercially available thermal printheads or infrared copy machines. Preferably, the overcoat composition further includes one or more photoinitiators capable of sufficiently polymerizing the said reactive monomers, a dry lubricant, and a mildly abrasive filler.

The composite film may optionally include an intermediate layer comprising a substantially water-soluble or dispersible polymeric material capable of promoting adhesion between the color-forming layer and the protective overcoat layer.

DETAILED DESCRIPTION OF THE INVENTION

Figure 1:
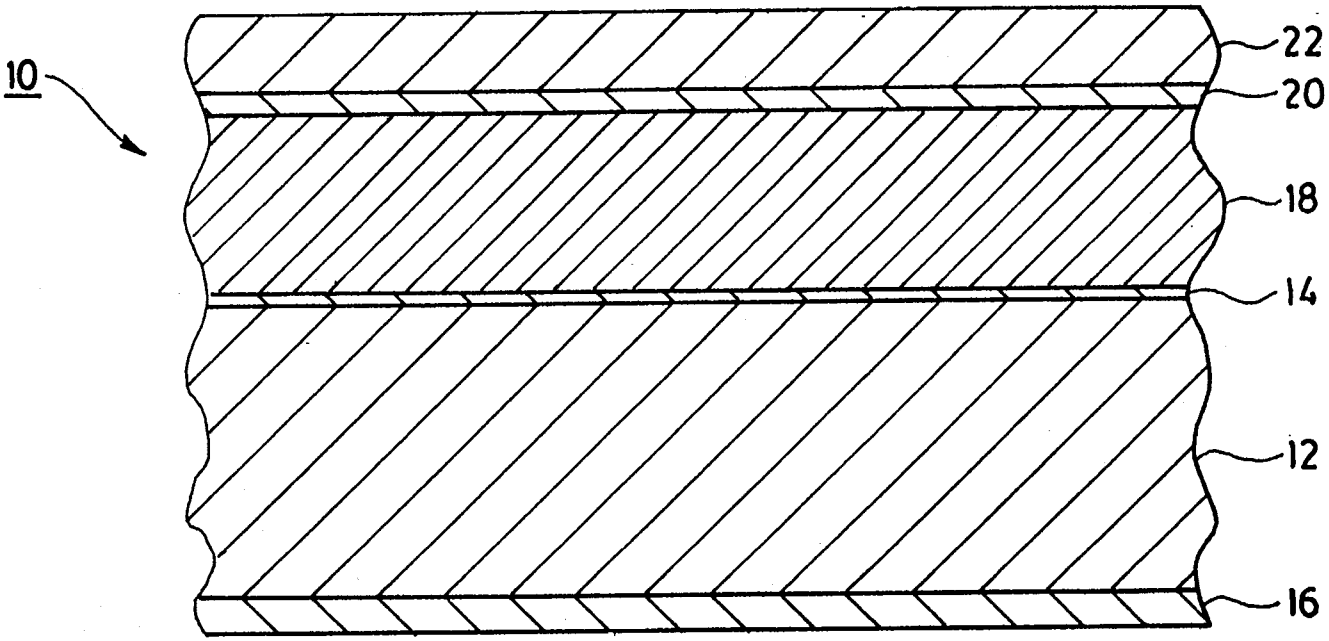
FIG. 1 shows an embodiment of a heat-sensitive film or paper according to the invention.

Referring to FIG. 1, embodiment 10 of the invention comprises substrate or support 12, which may be, for example, paper, glass, or a plastic sheeting or film. Suitable film-forming plastic substrates are, for example, poly(ethylene terephthalate), polyolefin, polycarbonate, polysulfone, polystyrene, and cellulose acetate. Support 12 can be transparent, translucent, or opaque. Support 12 typically is provided with adhesion or subbing layer 14. One or more backing layers 16 may be provided to control physical properties such as curl or static. An example of a suitable, commercially available support is Melenex 6093, available from ICI, Ltd., which comprises 2.65-mil poly(ethylene terephthalate), subbed on one side and carrying on the other side an anti static coating showing a resistance of about $2\times10^{10}$ ohms. Carried by subbing layer 14 is color-forming layer 18 comprising a heat-sensitive coated composition. Tie layer 20 can be optionally included to improve adhesion between color-forming layer 18 and protective, clarifying overcoat 22.

In the novel color-forming layer of the present invention, the preferred color-forming noble metal organic acid salt is silver behenate, which is colorless, stable toward light and insoluble in an aqueous vehicle. Silver stearate may be successfully substituted for silver behenate, and silver and gold salts of many other organic acids have also been found useful in heat-sensitive compositions and copying papers as previously described in U.S. Pat. No. 3,080,254, which is incorporated herein by reference. A partial list of such organic acids suitable for use in the present invention includes oleic, lauric, hydroxystearic, acetic, phthalic, terephthalic, butyric, m-nitrobenzoic, salicylic,, phenylacetic, pyromellitic, p-phenylbenzoic, undecylenic, camphoric, furoic, acetamidobenzoic and o-aminobenzoic.

Reducing agents which have been found useful with such compounds in the formulation of heat-sensitive copysheets include: pyrogallol; 4-azeloyl-bis-pyrogallol; 4-stearoyl pyrogallol; galloacetophenone; di-tertiary-butyl pyrogallol; gallic acid anilide; methyl gallate; ethyl gallate; normal- and iso-propyl gallate; butyl gallate; dodecyl gallate; gallic acid; ammonium gallate; ethyl protocatechuate; cetyl protocatechuate; 2,5-dihydroxy benzoic acid; 1-hydroxy-2-naphthoic acid; 2-hydroxy-3-naphthoic acid; phloroglucinol; catechol; 2,3-naphthalene diol; 4-lauroyl catechol; sodium gallate; protocatechualdehyde; 4-methyl esculetin; 3,4-dihydroxy benzoic acid; 2,3-dihydroxy benzoic acid; hydroquinone; 4,4'-dihydroxy biphenyl; 3-4-dihydroxyphenylacetic acid; 4-(3',4'-dihydroxyphenylazo)benzoic acid; 2,2'-methylene bis-3,4,5-trihydroxybenzoic acid; ortho- and para-phenylene diamine; tetramethyl benzidine; 4,4',4''-diethylamino triphenylmethane; o-, m-, and p-aminobenzoic acids; alpha and beta naphthols; 4-methoxy, 1-hydroxy-dihydronaphthalene; and tetrahydroquinoline. Those compounds are cyclic or aromatic compounds having an active hydrogen atom attached to an atom of carbon, oxygen or nitrogen which in turn is attached to an atom of the cyclic ring. They are capable of causing the reduction of noble metal ions and precipitation of metallic noble metals.

The preferred organic reducing agents are those which are alkyl esters of gallic acid, for example, methyl, ethyl, propyl, octyl, dodecyl and cetyl esters. Especially preferred are ethyl, propyl and octyl esters. These gallic esters conform to the general formula $$(HO)_3C_6H_2COOR$$

where R is an alkyl radical.

The amount of color-forming noble metal salt and organic reducing agent will vary, largely depending upon the particular noble metal salt being used and the desired shade and intensity of color in the produced colored marks. Generally, the amount of color-forming metal salt present in the composition of the color-forming layer will vary from 10% to 60%, by weight, preferably from 25% to 40%, and most preferably from 30% to 35% on a percent solids basis, i.e., without taking into account the water in which the composition is ultimately dissolved or dispersed. The amount of organic reducing agent in the composition of the color-forming layer will vary from 2% to 25%, by weight, preferably from 3% to 10% and most preferably from 4% to 8% on a percent solids basis.

Both the color-forming salt and the organic reducing agent must be homogeneously distributed through the composition. The metal salt should be in finely divided form, preferably as particles having a size of from about 0.5 to 10 microns; and most preferably 1 to 3 microns.

The organic reducing agents have limited solubility in water, a major obstacle to previous attempts at formulating aqueous carrier compositions. For example, the octyl ester of gallic acid has a solubility of 0.001 g/100 g water while the ethyl ester of gallic acid has a solubility of at 0.6 g/100 g water. An important aspect of the invention is the unexpected discovery that by dispersing the organic reducing agent in an aqueous solution of polyvinyl alcohol, employed as a carrier polymer, and incorporating a dispersing agent typically used for the fine grinding of developers used in the manufacture of direct thermal printing papers, then subjecting the resulting dispersion to a temperature of 130 degrees F., a clear solution was obtained that was stable at room temperature for 24 to 72 hours.

As shown in Table I, these unexpected results were obtained with the combination of a polymeric carrier material (polyvinyl alcohol), a dispersing agent, and water. The polyvinyl alcohol used was partially hydrolyzed (87–89%), available as Airvol 203 from Air Products Inc. The dispersing agent used was Lupasol FF-3249, an ammonium salt of styrene/acrylic acid copolymer sold by BASF Corp.

TABLE I

| | Solution g/100 g* | Solution Life (hrs) | Solution Appearance (24 hr.) |
|---|---|---|---|
| Solution A: Water Only | .35 | 0 | moderately cloudy |
| Solution B: PvOH (20% solution in water) Only | 2.20 | >1 wk | virtually clear |
| Solution C: Lupasol (35% solution in water) Only | 2.20 | 2 hr | moderately cloudy |
| Solution D: PvOH/Lupasol (about 25% solution of PvOH/Lupasol (2.5:1) mixture in water) | 4.40 | 72 hr | virtually clear |

*Grams of propyl gallate reducing agent in 100 grams of deonized water.

As can be seen from Table I, only Solution D, the combination of the dispersing agent, polyvinyl alcohol (PvOH) and propyl gallate, provides a stable solution at maximum solubility for the propyl gallate reducing agent. Increasing the solubility of propyl gallate, as obtained in Solution D versus with polyvinyl alcohol alone in water or Lupasol alone in water is significant in that, among other benefits, greater flexibility to vary the amount of carrier material and, therefore, to vary the coating conditions, is achieved without deleterious effects on sensitivity.

The relative amounts of polyvinyl alcohol and Lupasol can vary from about 50% to about 90% polyvinyl alcohol (i.e. about 10% to about 50% Lupasol), preferably from about 60% to about 70% polyvinyl alcohol (i.e. about 20% to about 30% Lupasol). Use of an insufficient amount of Lupasol may result in an insufficient quantity of propyl gallate in solution. Conversely, an insufficient concentration of polyvinyl alcohol will result in premature precipitation of the propyl gallate. The dispersing agent is present in the heat-sensitive composition in an amount of 3–25 weight % of the solids content, preferably 5–10 weight % and, most preferably, 6–7 weight %.

Phthalazone, also known as phthalazinone, is the preferred material for use as a toning agent and is more fully described in U.S. Pat. No. 3,080,254 previously incorporated herein by reference. Other suitable materials that can also be used as the toning agent include barbituric acid, 2-benzoxazolethiol, and 1-acetal-2-thiohydantoin.

Generally, the amount of phthalazone in the color-forming layer can be from 2% to 25%, by weight, preferably from 3% to 1.5%, and most preferably from 4% to 6%. In these amounts, the weight ratio of the noble metal salt to phthalazone will be between about 4:1 to 8:1 with a weight ratio of about 6:1 being most preferred. The phthalazone is preferably ground with the noble metal salt to a particle size of from 0.5 to 10 microns, and most preferably 1 to 3 microns.

The carrier composition in which the noble metal salt, organic reducing agent and phthalazone are distributed comprises one or more substantially water-soluble, fully or partially-hydrolyzed grades of polyvinyl alcohol. The preferred degree of hydrolysis is from about 87% to 89%. The viscosity of the composition can be readily adjusted to any level by varying the amount of polyvinyl alcohol or by selection of higher or lower molecular weight.

Other water-soluble polymeric materials suitable for use with or in place of the polyvinyl alcohol carrier material in this invention would include methyl cellulose, carboxy methyl cellulose, polysaccharide gums, gelatins, styrene butadiene copolymers, hydroxylated corn starch, acrylic latexes, vinyl acetate copolymers, and blends or mixtures thereof. Generally, the total amount of carrier in the composition of the color-forming layer will be between 10% and 60%, by weight, preferably from 25% to 50%, and most preferably from 40% to 50%.

The coating composition may also optionally include common wetting agents, surfactants, and various additional components for enhancing the properties of the composition such as anti-foggants, coating aids, and hardeners for the polyvinyl alcohol or other carrier materials.

Suitable anti-foggants are well-known photographic anti-foggants such as 2-mercaptobenzo-triazole, chromate, oxalate, citrate, carbonate, benzotriazole (BZT), 5-methylbenzotriazole, 5,6-dimethylbenzotriazole, 5-bromobenzotriazole, 5-chlorobenzotriazole, 5-nitrobenzotriazole, 4-nitro-6-chlorobenzotriazole, 5-nitro-6-chlorobenzotriazole, 4-hydroxy-6-methyl-1,3,3a,7-tetraazaindene, benzimidazole, 2-methylbenzimidazole, 5-nitrobenzimidazole, 1-phenyl-5-mercaptotetrazole (PMT), 2-mercaptobenzimidazole, 2-mercaptobenzothiazole, 2-mercaptobenzoxazole, 2-mercaptothiazoline, 2-mercapto-4-methyl-6,6'-dimethylpyrimidine, 1-ethyl-2-mercapto-5-amino-1,3,4-triazole, 1-ethyl-5-mercapto-1,2,3,4-tetrazole, 2,5-dimercapto-1,3,4-thiodiazole, 2-mercapto-5-amino-1,3,4-thiodiazole, dimethyldithiocarbamate, and diethyl dithiocarbamate.

Anti-foggants having relatively low solubility are preferred. Especially preferred are those having a $pK_{sp}$ of from about 14 to about 20.

Boric acid is an example of a suitable hardener for the polyvinyl alcohol carrier material. Other suitable materials are hardener and crosslinking materials known to those skilled in the art.

Surfactants and wetting agents, such as FC-129 (an anionic fluorosurfactant consisting of 50% potassium fluoroalkyl carboxylates dissolved in 2-butoxyethanol, ethyl alcohol and water, available from 3M Industrial Chemical Products Division in St. Paul, Minn.) may also be incorporated into the coating composition to prevent repellency defects such as "fisheyes" or spots. Such surfactants can be present in the composition of the color-forming layer at a concentration of from about 0.01% to about 0.5% based on the weight of the composition.

The total concentration of these and other various addenda in the final coating composition can range from about 0.01% to about 5% of the composition on a percent solids basis. By "percent solids basis" is meant the weight percent based on the combined weight of the non-aqueous components of the coating composition. Depending on the particular materials employed, the, various addenda may be incorporated in or ground with the color-forming metal salt and other components to be finely divided, or dissolved in the solution or dispersion of the carrier material in water.

Preferably, the silver salt, toning agent and other materials to be finely ground are mixed and ground together in a dispersion or solution of the carrier material in water. The silver salt composition is ground to an average particle size of from about 0.5 to about 3 μm. As described above, the reducing agent is dissolved in a solution of polyvinyl alcohol, dispersing agent, and water. The resulting silver salt grind and reducing agent compositions are then mixed together into a single coating composition which can be applied to a support optionally after being further diluted with water. The total amount of water present in the color-forming layer coating composition can range from 40% to 95%, preferably 60% to 85%.

The color-forming layer coating composition can be coated at a coating flow rate to yield a dried coverage of from about 0.5 to about 3.0 lb/MSF, preferably from about 0.9 to about 2.2 lb/MSF. By "lb/MSF" is meant pounds per 1000 square feet.

The composition is coated and passed through a drying tunnel at a rate of about 100 to about 200 feet per minute, at a drying temperature of from about 140 to about 200 degrees F., depending upon the coating speed. The water is evaporated from the coating leaving color-forming layer 18 adhered to subbing layer 14 and thereby to support 12.

When using a plastic support any suitable, compatible material may be used as listed hereinbefore. Alternatively, the color-forming layer coating: composition may be applied to paper or other support.

As previously stated, the compositions of the present invention may be used in films suitable for thermal copying as well in direct thermal printing films comprising (1) a substrate or support formed from a flexible material, (2) a color-forming layer of the thermally imageable material of the present invention applied to at least one surface of the substrate, (3) an optional intermediate layer capable of promoting intercoat adhesion between the color-forming layer and (4) a protective, clarifying overcoat having sufficient hardness and frictional properties to allow for direct thermal recording. In this embodiment, the composite layers produce a film transparent to visible, UV and infrared light. The coated layers are sufficiently flexible that the substrate bearing them can be imaged in commercially available infrared copying machines and can be wound into rolls or used as sheets in commercially available direct thermal printing devices.

As previously stated, a primary feature of the invention is the discovery that the combination of polyvinyl alcohol or equivalent water-soluble polymeric material, Lupasol FF-3249 dispersing agent, and water totally dissolves the organic reducing agent, greatly increasing the clarity of the finished product and improving its imaging characteristics due to the intimate relationship of the solution to the noble metal salt in dispersion. The D max exhibited by the film of the invention is greater than could be achieved by compositions wherein the organic reducing agent is in particulate form.

The carrier composition may also optionally include common wetting agents, surfactants and various additional components for enhancing the properties of the composition.

In some applications it has been found useful to incorporate an optional intermediate layer or "tie" coat that promotes adhesion between the color-forming layer and the protective overcoat. The use of an intermediate layer has been particularly useful to avoid polymer incompatibility that can occur when adhesion promoting resins are added to the color-forming layer. Styrene butadiene copolymers are especially preferred for this purpose. Other materials that work well are polyvinyl acetate copolymers, and polyurethanes.

Generally, the concentration of the intermediate layer adhesion-promoting material will vary from 5% to 50%, by weight in deionized water, preferably from 10% to 20% and most preferably from 15% to 18%. The intermediate layer may also contain wetting agents, surfactants and various additional components for enhancing properties of the composition. Other conventional materials or additives that promote adhesion can also be included in the composition without departing from the spirit of the invention. Similarly, these additives or materials can be added directly to the color-forming layer and be considered within the scope of the invention.

The use of an overcoat layer serves multiple purposes. The primary function of the overcoat in the present invention is to achieve maximum optical clarity. Secondly, but also important, it is to provide protection for the color-forming layer. The overcoat protects the color-forming layer from fingerprinting and abrasion when the transparency sheets are handled in normal use, as well as from exposure to the elements, particularly moisture at elevated temperature and humidity. An overcoat layer resistant to various common hazards is highly beneficial to the user.

Selection of the appropriate materials for an overcoat composition demands definition of the requirements. There are many materials which are suitable to achieve clarity and protection from the elements, but fall short regarding other important factors such as being environmentally safe or solvent free, having good frictional properties which relate to feed properties in various thermal printing devices, and non-sticking properties both to thermal printheads and to various; laser- or toner-based originals. The overcoat must not hinder or retard the imaging characteristics. Lastly, the overcoat must be chemically compatible with the underlying color layer and must not cause premature color formation.

It has been determined that certain radiation curable materials meet all of the above desired characteristics and requirements.

The resins selected offer superior optical clarity and exhibit exceptional protection from, particularly, moisture and heat. The non-overcoated color-forming layer typically appears hazy. This is thought to result from light scattering at the surface of the color-forming layer. The addition of an overcoat according to the invention yields a heat-sensitive material of exceptional optical clarity. In this regard, the radiation-curable overcoats of the invention are markedly superior to non-cured overcoats. Since radiation curable coatings are typically manufactured and coated as a liquid at 100% solids, they are solvent-free, and thereby enjoy the safety and cost benefits noted hereinabove.

Sticking of the image-forming material against a hot print head can be prevented by the selection of monomers or oligomers of varying molecular weight and composition to control hardness, flexibility, and melting or softening point. It is also possible to eliminate sticking by selecting polymers which have no glass transition temperature ($T_g$) or melting point ($T_f$) but which rather decompose without residue. Selection of the photoinitiator also must be based on degree of cure or polymerization required for the particular application.

The curable overcoat composition can comprise one or more acrylic or vinylic monomers, a photoinitiator and typically a wetting agent. Other materials, such as surfactants, slip agents, dry lubricants, mar resistance agents, and inert fillers may optionally be included in order to enhance the properties of the overcoat layer.

Examples of suitable slip agents, which also increase the mar resistance of the overcoat layer, are silicone compounds such as modified or unmodified dimethyl polysiloxanes, including the polyether modified, polyester modified, and polyester modified reactive dimethylpolysiloxanes sold by BYK-Chemie USA of Wallingford, Conn. under the trademarks BYK®-300, -301, 302, -307, -310, -320, -321, -322, -325, -330, -331, -336, -341, -344, -351, -370, 085, and other similar materials. Other suitable materials include acrylic and methacrylic functional silicones such as BYK®-371 sold by BYK Chemie, those available from Hals America, Inc. of Piscataway, N.J. under the designations Hals PS560, PS583, PS802, PS851, PS852, PS853, PS854, PS406, PS901, PS9015, and the product sold by Dow Corning as Additive 28. These and other known slip agents may be used either alone or in combination, at concentrations ranging from about 0.05 to about 5%, preferably from about 0.05 to about 3.0% of the total overcoat composition. Such materials may be incorporated in order to prevent sticking of the imaging member to the thermal print head, as well as to increase the mar resistance of the final product.

The overcoat composition may also include inert filler materials which serve to prevent the accumulation of debris on the print head and to reduce the coefficient of friction for proper transport through the thermal printing apparatus. Suitable filler materials are those which have mild abrasive properties, high oil absorption characteristics, for example in the range of from about 40 g to about 150 g oil/100 g filler, and an average particle size of about 1.1 μm. Aluminum oxide (alumina) having an average particle size of about 1.0 to about 5.0 μm is a preferred filler material. Other suitable filler materials include barium sulfate, calcium carbonate, clays, synthetic silicas, silica, titanium dioxide, zinc oxide, talc, chromium oxide, aluminum hydrates, fluorinated polyethylene and microcrystalline waxes. Such filler materials can be present in the overcoat composition at amounts of from about 0.5% to about 5% by weight of the total composition, preferably from about 0.9% to about 2% of the total.

Suitable dry lubricants in the overcoat composition comprise the metal salts of long-chain aliphatic carboxylates, for example, zinc stearate and calcium stearate.

Examples of suitable radiation-curable monomers include: N-vinyl pyrrolidone, allyl methacrylate, tetrahydrofurfuryl methacrylate, cyclohexyl methacrylate, n-hexyl methacrylate, cyclohexyl acrylate, 2-ethoxyethyl acrylate, 2-ethoxyethyl methacrylate, isodecyl methacrylate, 2-methoxyethyl acrylate, ethoxyethoxy) ethylacrylate, stearyl acrylate, behenyl acrylate, nonyl phenol ethoxylate acrylate, tetrahydrofural acrylate, lauryl methacrylate, stearyl methacrylate, octyl acrylate, lauryl acrylate, monomethoxy 1,6-hexanediol acrylate, monomethoxy tripropylene glycol acrylate, monomethoxy neopentyl glycol propoxylate acrylate, 2-phenoxymethyl acrylate, 2-phenoxyethyl methacrylate, glycidyl methacrylate, isodecyl acrylate, isobornyl methacrylate, benzyl acrylate, hexyl acrylate, isooctyl acrylate, tridecyl methacrylate, caprolactone acrylate, isobornyl acrylate, triethylene glycol dimethacrylate, ethylene glycol dimethacrylate, tetraethylene glycol dimethacrylate, polyethylene glycol dimethacrylate, 1,3-butylene glycol diacrylate, 1,4-butenediol diacrylate, 1,4-butanediol dimethacrylate, diethylene glycol diacrylate, diethylene glycol dimethacrylate, 1,6-hexanediol diacrylate, 1,6-hexanediol dimethacrylate, 1,6-hexanediol diglycidyl ether, bisphenol A propoxylate diglycidyl ether, bisphenol A ethoxylate diglycidyl ether, neopentyl glycol propoxylate diglycidyl ether, neopentyl glycol diacrylate, neopentyl glycol propoxylate diacrylate, neopentyl glycol dimethacrylate, polyethylene glycol (200) diacrylate, tetraethylene glycol diacrylate, triethylene glycol diacrylate dimethacrylate, 1,3 butylene glycol dimethacrylate, tripropylene glycol diacrylate, ethoxylated bisphenol A dimethacrylate, ethoxylated bisphenol A diacrylate, bisphenol A propoxylate diacrylate, tris (2-hydroxyl ethyl) isocyanurate trimethacrylate, pentaerythritol tetraacrylate, trimethylpropane trimethacrylate, trimethylpropane triacrylate, trimethylpropane propoxylate triacrylate, glyceryl propoxylate triacrylate, trimethylpropane ethoxylate triglycidyl ether, tris (2-hydroxy ethyl) isocyanurate triacrylate, dipentaerythritol pentaacrylate, pentaerythritol triacrylate, ethoxylated pentaerythritol tetraacrylate, polyethylene glycol (600) dimethacrylate, polyethylene glycol (600) diacrylate, polyethylene glycol (400) diacrylate, polypropylene glycol monomethacrylate, polypropylene glycol monoacrylate, ditrimethylpropane tetraacrylate, ethoxylated trimethylpropane triacrylate, propoxylated trimethylpropane triacrylate, propoxylated neopentyl glycol diacrylate, glyceryl propoxy triacrylate, propoxylated glyceryl triacrylate, pentaacrylate ester, alkoxylated aliphatic diacrylate ester, alkoxylated trifunctional acrylate, trifunctional methacrylate ester, trifunctional acrylate ester, aliphatic monofunctional ester, aliphatic difunctional ester, alkoxylated diacrylate ester:, polybutadiene diacrylate, aliphatic urethane acrylate, aromatic urethane acrylate, epoxy acrylate, bisphenol A epoxy diacrylate, and polyester acrylate.

Examples of suitable photoinitiators include: benzyldimethyl ketal, trimethylbenzophenone, isopropylthioxanthone, ethyl 4-(dimethylaminobenzoate), benzophenone, 2-hydroxy-2-methyl-1-phenyl-propan-1-one, 2,2 dimethoxy-2-phenylacetophenone, 2,2-dimethoxy-1,2-diphenyl ethanone, 2-hydroxy-2-methyl-1-phenyl propanone, and 2-methyl-1-(4-(methylthio)phenyl)-2-morpholinopropanone-1. The preferred photoinitiator is 1-hydroxycyclohexyl phenyl ketone.

The amount of the photoinitiator can range from 2% to 30%, by weight, preferably from 2% to 15% and most preferably from 5% to 10%.

Other conventional additives, such as wetting and dispersing agents or materials commonly used in heat-sensitive compositions other than those previously mentioned, can also be included in the radiation-curable overcoat composition without departing from the spirit of the invention.

The overcoat composition may be applied to the color-forming layer or to an intermediate layer that has been applied to the color-forming layer at a coating rate to yield a dry coverage of from about 0.2 to about 1.0 lb/MSF, preferably from about 0.50 to about 1.0 lb/MSF.

Following application of the overcoat composition as described above, the radiation-curable topcoat is cured by passing the coated member through an Aetek UV XL processor at a rate of about 100 to about 200 feet per minute. At 100 feet per minute the preferred overcoat composition described in Example 3 requires approximately 50 mj of energy to polymerize completely. One UV lamp at 300 watts per inch will achieve this energy level. Higher line speeds can be accomplished by using more lamps and increased wattage. Alternatively, conventional electron-beam curing can be employed.

U.S. Pat. Nos. 3,080,254, 3,031,329, 3,446,648 and 5,026,606, as previously described herein, teach various prior art compositions, structural configurations and process techniques known to the art which may be used with the present invention. These four patents are incorporated herein by reference.

EXAMPLES

To illustrate this and other aspects of the invention, the following examples are provided. It should be understood that the purpose of the examples is to illustrate several embodiments of the invention and is in no way intended to limit the scope of the invention. Conventional additives for heat-sensitive compositions other than those previously mentioned can also be included in the composition without departing from the spirit of the invention.

EXAMPLE 1

An aqueous heat-sensitive composition for thermal imaging devices is made as follows: A color-forming suspension (Mix 1) of solids having the following composition was prepared by grinding the listed ingredients at a concentration of about 20% by weight in deionized water to a particle size of about 1 to 3 microns to form a dispersion of silver behenate and phthalazone in an aqueous solution of polyvinyl alcohol.

| Mix 1 | Dry Weight % |
|---|---|
| Silver Behenate | 58.72 |
| Phthalazone | 9.02 |
| Polyvinyl Alcohol* | 32.26 |
| | 100.00 |

A color-developing mixture (Mix 2) of solids having the following composition was prepared by dispersing and blending the ingredients at 130° F. at a concentration of about 18% by weight in deionized water until all solids were dissolved.

| Mix 2 | Dry Weight % |
|---|---|
| Propyl Gallate | 23.40 |
| Polyvinyl Alcohol* | 54.42 |
| Lupasol FF 3249 | 22.18 |
| | 100.00 |

A solution of polyvinyl alcohol carrier vehicle in water (Mix 3) was prepared by dissolving polyvinyl alcohol* in deionized water to form a solution having a concentration of about 22% by weight of polyvinyl alcohol.

*The polyvinyl alcohol used in the examples was 87–89% hydrolyzed dispersing grade Airvol 203.

The three mixes (Mixes 1, 2, and 3 were then blended together in equal parts to give a final heat-sensitive coating composition having the following formula:

| | Dry Weight % |
|---|---|
| Silver Behenate | 36.90 |
| Phthalazone | 6.43 |
| Propyl Gallate | 6.76 |
| Lupasol FF 3249 | 6.41 |
| Polyvinyl Alcohol | 43.50 |
| | 100.00 |

The composition formed above was applied to a clear 2.65 mil polyethylene terephthalate film support available from ICI Corp. under the trade name Melinex 6093. The coated composition was dried at 140° F. Two sets of coated samples at different coverages were prepared for further coating and later testing: Sample A, 0.9 lb/MSF and Sample B, 2.2 lb/MSF, dry coverages.

EXAMPLE 2

An intermediate tie layer coating composition was prepared by dissolving a styrene butadiene copolymer available from BASF Corp. under the trade name Styrofan ND 593 in deionized water to form a solution having a concentration of about 10% by weight of copolymer in water. This composition (Sample C in Table II, below) was applied to a length of each of the color-forming layers of Example 1, Samples A and B, at between 0.02 and 0.15 lb/MSF, dry coverage, resulting in Samples AC and BC, respectively, as well as the original Samples A and B.

EXAMPLE 3

A radiation-curable overcoat formulation designated Mix E and having the following composition was prepared:

| Mix E | Weight % |
|---|---|
| Monomer A (1,6-Hexanediol Diacrylate) | 27.30 |
| Monomer B (Dipentaerythritol Hydroxy-Penta Acrylate) | 63.60 |
| Photoinitiator (2-Hydroxy-Methyl-1-Phenyl Propanone | 8.20 |
| Wetting Agent | .90 |

-continued

| Mix E | Weight % |
|---|---|
| | 100.00 |

This composition was applied at a coverage of 0.60lb/MSF to each of Samples A, B, AC, and BC, resulting in four structures (AE, BE, ACE, and BCE), having two levels of color-forming layer coverage, and presence or absence of an intermediate tie layer.

The overcoated samples were radiation cured by exposure to an ultraviolet source of 50 mj intensity per $cm^2$.

EXAMPLE 4

The imaging and keeping properties of film made according to the present invention were measured, and the results are reported in Table II. The transmission density "D" is measured for nonimaged or unexposed areas ($D_{min}$) and for imaged or exposed areas ($D_{max}$). More specifically, the data in Table II were obtained by imaging samples on a heated metal block at 300 degrees F. The value obtained at 300 degrees F. is the D max, whereas the unimaged or area not subjected to 300 degrees is the D min value. The actual data or value recorded is a direct reading from the densitometer.

Table II shows data from samples as manufactured in Example 3, as well as from identical samples aged for 24 hours at 60° C. and ambient RH ("Heat"), and for 24 hours at 50° C. at 65% RH ("Heat and Moisture").

TABLE II

| Sample | As Coated | | Heat | | Heat and Moisture | |
|---|---|---|---|---|---|---|
| Structure | $D_{min}$ | $D_{max}$ | $D_{min}$ | $D_{max}$ | $D_{min}$ | $D_{max}$ |
| (A,E) | .06 | 1.45 | .07 | 1.55 | .08 | 1.55 |
| (B,E) | .09 | 3.50 | .10 | 4.00 | .14 | 4.00 |
| (A,C,E) | .06 | 1.45 | .07 | 1.55 | .08 | 1.55 |
| (B,C,E) | .09 | 3.50 | .10 | 4.00 | .14 | 4.00 |

Values recorded in Table II were obtained using an X-RITE, Model 361T transmission densitometer.

EXAMPLE 5

The ability of the four composite structures of Example 3 to meet important physical and functional requirements previously noted for both infrared imaging and direct thermal printing was evaluated against Brand X, a commercially available heat-sensitive transparency film.

Transparency printing characteristics were tested on a 3M Transparency Maker using originals created on a wide variety of plain paper copiers including Xerox, Canon and Royal. Images were made at different heat settings in order to adequately evaluate the sticking or release properties of the transparency from the original.

Thermal printing characteristics were evaluated using an Atlantek Model 200 Thermal Response Tester and using a wide variety of test conditions, for example, increasing and decreasing voltage to the print head and varying the pulse width of the printing cycle. The results of the evaluations are shown in Table III.

TABLE III

| Sample Structure | Release From Originals | Stick to Printheads | Image Color |
|---|---|---|---|
| (A,E) | Excellent | None | Black |
| (A,C,E) | Excellent | None | Black |

TABLE III-continued

| Sample Structure | Release From Originals | Stick to Printheads | Image Color |
|---|---|---|---|
| (B,E) | Excellent | None | Black |
| (B,C,E) | Excellent | None | Black |
| Brand X | Fair | Severe | Black |

These tests show that the four embodiments of the present invention exhibited superior release and stick properties when compared to a commercially available heat-sensitive transparency film.

EXAMPLE 6

A preferred embodiment is a heat-sensitive coating formulation having the following composition:

| Component | % Solids |
|---|---|
| Silver Behenate | 32.28 |
| Polyvinyl Alcohol | 46.88 |
| Phthalazone | 4.94 |
| Mercaptobenzotriazole | 0.76 |
| Boric Acid | 1.92 |
| Lupasol FF 3249 | 6.40 |
| Propyl Gallate | 6.75 |
| FC-129 (surfactant) | 0.07 |
| | 100.00 |

This composition was prepared by the method of Example 1 and diluted to a concentration of 20% of the above combination of components in water for a coating composition as follows:

| Component | Weight % |
|---|---|
| Water | 80.000 |
| Silver Behenate | 6.456 |
| Polyvinyl Alcohol | 9.376 |
| Phthalazone | 0.988 |
| Mercaptobenzotriazole | 0.152 |
| Boric Acid | 0.384 |
| Lupasol FF 3249 | 1.280 |
| Propyl Gallate | 1.350 |
| FC-129 (surfactant) | 0.014 |
| | 100.00 |

The resulting image-forming composition was coated at a dried weight of 2.2 lb/MSF.

EXAMPLE 7

The following is a preferred overcoat composition:

| | % Solids |
|---|---|
| Pentaerythritol Triacrylate* | 71.42 |
| 1-Hydroxycyclohexyl phenyl ketone** | 6.26 |
| N-Vinyl pyrrolidone* | 17.71 |
| Calcium stearate*** | 2.78 |
| Aluminum oxide**** | 1.83 |
| | 100.00 |

*available from ISP Technologies, Inc.
**available from Ciba Geigy.
***available from Witco Chemical.
****available as aluminum oxide C from Degussa Corp.

The resulting overcoat composition was coated at a weight of 0.55 lb/MSF.

The invention described herein discloses a product and method which enables manufacture of the color-forming composition without organic solvents. The unique process provides for a solution in water of primary developer materials, previously found to be insoluble in water. Due to the importance of protecting the environment, and the greater safety associated with aqueous versus organic solutions, the invention is believed to be a significant scientific discovery which provides a positive environmental impact.

While the present invention has been described in terms of certain preferred embodiments and exemplified with respect thereto, one skilled in the art will readily appreciate that various modifications, changes, omissions and substitutions may be made without departing from the spirit thereof.

We claim:

1. A multilayer heat-sensitive material which comprises:

(a) a color-forming layer comprising:

a color-forming amount of finely divided, solid colorless noble metal salt of an organic acid;

a color-developing amount of an alkyl ester of gallic acid, which at thermal copy and printing temperatures is capable of a color-forming reaction with said noble metal salt;

an image toning agent; and a carrier composition in which said noble metal salt and said alkyl ester of gallic acid are distributed, comprising polyvinyl alcohol and a solubility-enhancing amount of an ammonium salt of a styrene/acrylic acid copolymer.

2. A material of claim 1 further comprising a protective overcoating layer over said color-forming layer.

3. A material of claim 1 in which said color-forming layer further includes a wetting agent and a surfactant,

4. A material of claim 1 in which said noble metal salt comprises silver behenate.

5. A material of claim 1 in which said alkyl ester of gallic acid comprises propyl gallate.

6. A material of claim 1 in which said toning agent comprises phthalazone.

7. A material of claim 2 which further comprises an adhesion-promoting layer between said color-forming layer and said protective overcoating layer.

8. A material of claim 2 wherein said overcoating layer is formed from a radiation-curable composition comprising one or more acrylate, glycidyl, or vinylic monomers.

9. A material of claim 8 wherein said radiation-curable composition comprises triacrylate and vinyl pyrrolidone monomers, a photoinitiator, a dry lubricant, and a filler material.

10. A material of claim 9 wherein said dry lubricant is selected from the group consisting of zinc stearate and calcium stearate.

11. A material of claim 8 wherein said overcoating layer is cured by radiation.

12. A material of claim 11 wherein said :radiation is ultraviolet light.

13. A material of claim 11 wherein said radiation is electron beam radiation.

14. A material of claim 9 wherein said filler material has an average particle size of about 0.01 to 50 μm.

15. A material of claim 9 wherein said filler material is selected from the group consisting of barium sulfate, calcium carbonate, clays, silica, titanium dioxide, zinc oxide, aluminum oxide, chromium oxide, aluminum hydrates, fluorinated polyethylene, and microcrystalline waxes.

16. A multilayer thermal imaging material which comprises:

(a) a flexible support;

(b) a heat-sensitive chemically-reactive layer overlying said support comprising a color-forming amount of finely divided, solid colorless noble metal salt of an organic acid, a color-developing amount of an alkyl ester of gallic acid, which at thermal copy and printing temperatures is capable of a color-forming reaction with said noble metal salt, an image toning amount of phthalazone, and a carrier composition in which said noble metal salt and alkyl ester of gallic acid are distributed comprising one or more substantially water-soluble partially-hydrolyzed polyvinyl alcohols and a solubility-enhancing amount of an ammonium salt of styrene/acrylic acid copolymer.

17. A material of claim 16 further comprising a protective overcoating layer formed from a radiation-curable composition comprising acrylic and vinylic monomer.

18. A material of claim 16 in which said support comprises polyethylene terephthalate.

19. A material of claim 16 in which said heat-sensitive layer further includes a wetting agent and a surfactant.

20. A material of claim 16 in which said noble metal salt comprises silver behenate.

21. A material of claim 16 in which said alkyl ester of gallic acid comprises propyl gallate.

22. A material of claim 17 in which said monomers are pentaerythritol triacrylate and N-vinyl pyrrolidone.

23. A material of claim 17 which further contains an adhesion promoting layer between said reactive layer and said overcoating layer.

24. A material of claim 18 wherein said protective overcoating layer is cured by radiation.

25. An aqueous heat-sensitive chemically-reactive composition comprising the components:

a color-forming amount of finely divided, solid colorless noble metal salt of an organic acid, a color-developing amount of an alkyl ester of gallic acid, which at thermal copy and printing temperatures is capable of a color-forming reaction with said noble metal salt;

an image-toning amount of a suitable toning agent; and an aqueous carrier composition in which said noble metal salt and alkyl ester of gallic acid are distributed comprising the components polyvinyl alcohol and a solubility-enhancing amount of an ammonium salt of a styrene/acrylic acid copolymer, said components being present in the following amounts:

| | Weight % Solids |
|---|---|
| Noble Metal Salt | 10–60 |
| Toning [Image Toner] Agent | 2–25 |
| Alkyl Ester of Gallic Acid [Reducing Agent] | 5–25 |
| Ammonium Salt of Styrene/Acrylic Acid Copolymer [Dispersing Agent] | 3–25 |
| Polyvinyl alcohol [Polymeric Carrier Material] | 10-60 |

26. An aqueous heat-sensitive chemically-reactive composition comprising the components:

a color-forming amount of finely divided silver behenate;

a color-developing amount of an alkyl ester of gallic acid, which at thermal copy and printing temperatures is capable of a color-forming reaction with said silver behenate;

an image-toning amount of phthalazone; and an aqueous carrier composition in which said silver behenate and alkyl ester of gallic acid are distributed, comprising the components one or more substantially water-soluble partially-hydrolyzed polyvinyl alcohols and a solubility-enhancing amount of an ammonium salt of styrene/acrylic acid copolymer dispersing agent, said components being present in the following amounts:

| | Weight % Solids |
|---|---|
| Silver Behenate | 25–40 |
| Phthalazone | 3–15 |
| Alkyl Ester of Gallic Acid [Reducing Agent] | 3–10 |
| Ammonium Salt of Styrene/Acrylic Acid Copolymer | 5–10 |
| Polyvinyl Alcohol | 25–50 |

27. A composition according to claim 26 wherein said alkyl ester of gallic acid is propyl gallate said components being present: in the following concentrations:

| | Weight % Solids |
|---|---|
| Silver Behenate | 30–35 |
| Phthalazone | 4–6 |
| Propyl gallate | 4–5 |
| [Lupasol FF 3249] Ammonium Salt of Styrene/Acrylic Acid Copolymer | 6–7 |
| Polyvinyl alcohol | 40–50 |

28. A method for forming an aqueous heat-sensitive composition suitable for coating to a support which comprises:

(a) forming a color-forming dispersion having the following composition by grinding in a concentration of 10%–40% in water to a particle size of about 0.5 to 10 microns:

| | Weight % in Solids |
|---|---|
| Silver Behenate | 10–60 |
| Phthalazone | 2–25 |
| Polyvinyl Alcohol | 10–60 |

(b) forming a clear, stable color-developing solution having the following composition:

| | Weight % in Solids |
|---|---|
| Propyl Gallate | 5–25 |
| Polyvinyl Alcohol | 10–60 |
| [Lupasol FF 3249] Ammonium salt of styrene/acrylic acid copolymer | 3–25 |
| Water | 10–30 |

the relative amounts of polyvinyl alcohol and said copolymer salt varying from about 50 to 90% polyvinyl alcohol and 10 to 50% copolymer salt, (c) mixing the dispersion of (a) and solution of (b) together to form an aqueous heat-sensitive coating composition suitable for use in forming a thermal imaging coating.

29. A method according to claim 28 wherein said heat-sensitive composition, when coated on a clear polymeric support, forms a thermal imaging film capable of development to a $D_{max}$ of 3.50 or higher in imaged areas while maintaining a $D_{min}$ as low as 0.09 in non-imaged areas.

30. A method for forming an aqueous heat-sensitive coating composition for a thermal imaging film which comprises uniformly dispersing finely divided particles of an alkyl ester of gallic acid in an aqueous solution containing polyvinyl alcohol and an ammonium salt of a styrene/acrylic acid copolymer and subjecting the resulting dispersion to an elevated temperature until a clear, stable solution is obtained, mixing said clear solution with a color-forming dispersion obtained by grinding in water to a particle size of about 0.5 to 10 microns a mixture of a noble metal salt of an organic acid, a toning agent and polyvinyl alcohol.

* * * * *